US006169236B1

(12) United States Patent
Pilar, Jr.

(10) Patent No.: US 6,169,236 B1
(45) Date of Patent: Jan. 2, 2001

(54) RESONANCE BRACING FOR STRINGED MUSICAL INSTRUMENT

(76) Inventor: William Del Pilar, Jr., 220 Atlantic Ave., Brooklyn, NY (US) 11201

( * ) Notice: Under 35 U.S.C. 154(b), the term of this patent shall be extended for 0 days.

(21) Appl. No.: 09/396,558

(22) Filed: Sep. 15, 1999

(51) Int. Cl.[7] ..... G10D 3/00
(52) U.S. Cl. ..... 84/291; 84/790; 84/267
(58) Field of Search ..... 84/290, 291, 267

(56) References Cited

U.S. PATENT DOCUMENTS

| | | | | |
|---|---|---|---|---|
| 448,217 | * | 3/1891 | Fairman | 84/291 |
| 508,858 | * | 11/1893 | Back | 84/291 |
| 1,762,408 | * | 8/1927 | Nelson | 84/291 |
| 1,768,471 | * | 6/1930 | Ferguson | 84/291 |
| 1,889,408 | * | 11/1932 | Larson | 84/291 |
| 3,302,507 | * | 2/1967 | Fender | 84/267 |
| 3,521,374 | * | 7/1970 | Reynolds | 34/19 |
| 3,656,395 | * | 4/1972 | Kaman | 84/267 |
| 4,079,654 | * | 3/1978 | Kasha | 84/291 |
| 4,084,475 | * | 4/1978 | Horowitz | 84/291 |
| 4,348,933 | * | 9/1982 | Kaman et al. | 84/193 |
| 4,573,391 | * | 3/1986 | White | 84/291 |
| 5,469,770 | * | 11/1995 | Taylor | 84/291 |
| 5,952,592 | * | 9/1999 | Teel | 84/291 |

* cited by examiner

*Primary Examiner*—Robert E. Nappi
*Assistant Examiner*—Kim Lockett
(74) *Attorney, Agent, or Firm*—Jordon B. Bierman; Bierman, Muserlian and Lucas

(57) ABSTRACT

The improvement in an acoustical musical stringed instrument having a flat soundboard with opposite top and bottom surfaces employing a plurality of elongated struts secured to the bottom surface of the soundboard in spaced apart positions. The struts cause the first side of the top surface of the soundboard to function as if it were stiffer and relatively short and wide and cause the second side of the top surface to function as if it were more compliant and relatively longer and narrower. The struts are progressively graduated in width and length from shorter and wider struts secured to the first side of the bottom surface to longer and narrower struts secured to the second side of the bottom surface whereby when the strings of the instrument are plucked to produce sound, the resonant frequency is enhanced by increasing the number of harmonics of higher frequency of the resonant frequency and the richness of sound is substantially enhanced.

8 Claims, 2 Drawing Sheets

RESONANCE BRACING FOR STRINGED MUSICAL INSTRUMENT

BACKGROUND OF THE INVENTION

Many different acoustical stringed instruments have strings secured by a bridge to the top surface of a flat soundboard. When one or more strings are plucked, the board vibrates to produce sound each with its own single resonant frequency and each having harmonics which are multiples of the resonant frequency. As these multiples increase in frequency, such as the second harmonic, the third harmonica and so on, the quality of the sound increases.

The strings that produce higher frequency sounds are disposed along one side of the board while the strings that produce lower frequency sounds are disposed along the other side of the board. These two sides are of like width and length and are disposed on opposite sides of an axis of symmetry so that the board has a symmetrical design In the present invention, the soundboard is differently designed in such manner as to provide additional multiples of increased frequency, thereby substantially enhancing the quality of sounds produced by the instrument.

SUMMARY OF THE INVENTION

In accordance with the principles of this invention, the soundboard while remaining symmetrically shaped is constrained by means secured to the back thereof in such manner that a first side of the board disposed below the strings that produce higher frequency sounds acts as if it were stiffer and relatively short and wide, while the second side of the board which is disposed below the strings which produce lower frequency sounds acts as if it were compliant and relatively longer and narrower than the first side.

The means secured to the back of the board include a plurality of spaced elongated flat struts which cause the second side of the board to function as if it were stiffer, shorter and wider than the first side and cause the first side of the board to function as if it were more compliant, longer and narrower than the second side. These struts are progressively graduated in width and in length from shorter and wider struts secured to the first side of the board to longer and narrower struts secured to the second side of the board. These struts are each oriented at different angles with respect to each other.

As a result, the instrument when plucked produces an enhanced resonant frequency with an increased number of higher frequency harmonics, thereby enhancing the richness of sound as compared to the response of the same instrument employing a conventional soundboard without the strut means employed in the present invention.

DETAILED DESCRIPTION OF PREFERRED EMBODIMENTS

Figure 1:
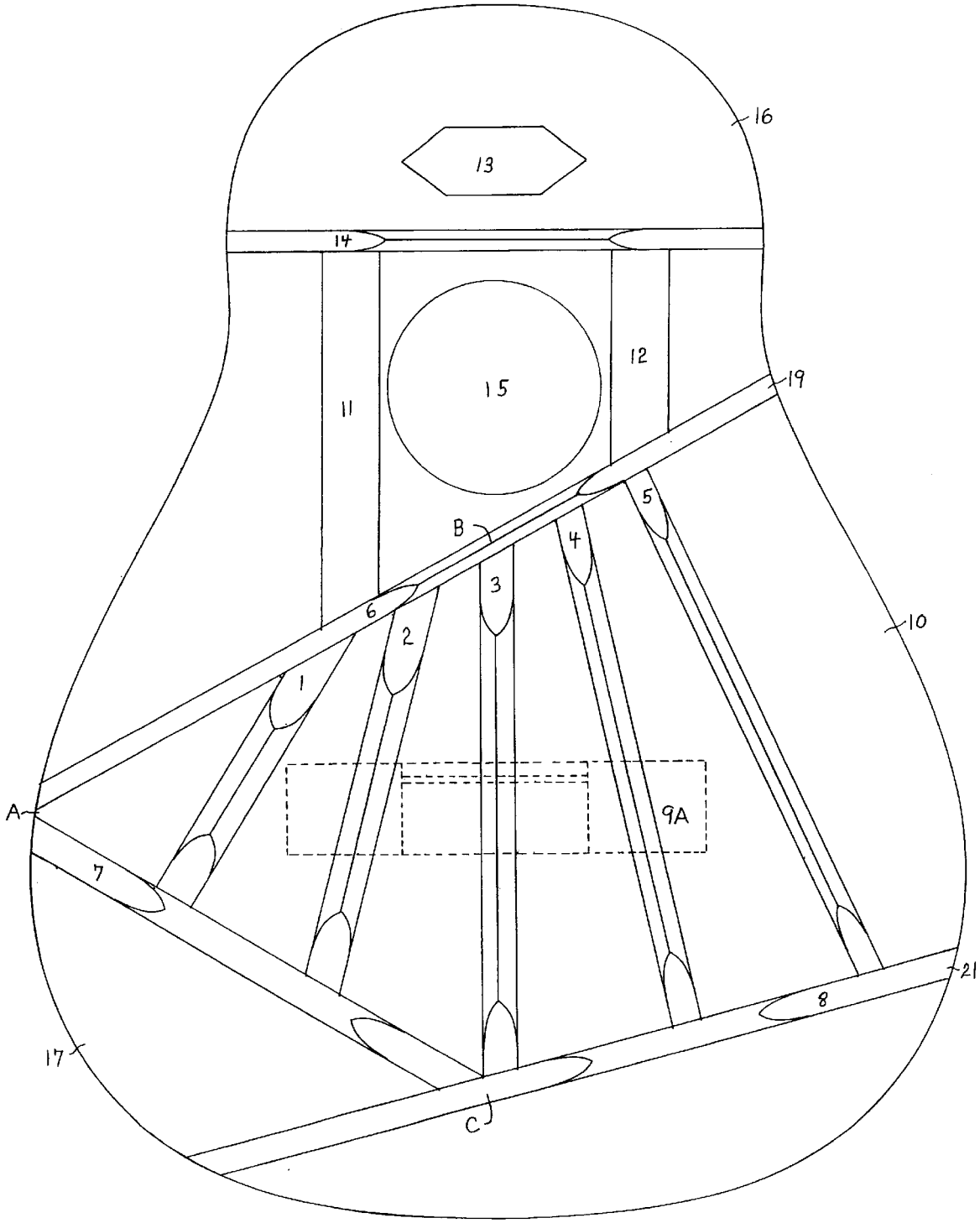
FIG. 1 is a schematic view of the underside of a soundboard system of a guitar in accordance with the invention.

In the drawings, like and corresponding parts are designated by the same reference numerals unless otherwise identified. The soundboard system shown in FIGS. 1 and 2 have in common the same component parts which have identical functions and while described only once apply to both. The struts as shown in both figures resemble in vertical cross section an isosceles triangle with the base being secured to the soundboard and the vertex being the highest raised level.

Referring now to FIG. 1, the soundboard 10 is composed of solid selected quarter sewn spruce, cedar or redwood used in plucked musical instruments such as a classical guitar or mandolin. The soundboard has an upper bout or section 16 and a lower, larger bout or section 17. A stop strut is a strut that has the ability to limit resonance, thus diagonal strut 6 is a stop strut having a relatively larger cross-section and stiffness than the other struts and is used to isolate the active portion of the lower bout 17 from the non active portion of the upper bout.

More particularly, the active area is the area at which resonance takes place, that is the area where reinforcement and prolongation of a particular frequency occurs by sympathetic vibration by a plucked string. This area lies within the boundaries of stop 6, treble strut 7 and bass strut 8.

Horizontally extending stop strut 14 has a relatively large cross-section and stiffness structurally supports the area of the soundboard from stresses produced by the pull of the strings and runs parallel with a short flat strut 13. This serves to prevent cracks in the soundboard otherwise produced by changes in expansion and contraction of the fingerboard [not shown] with changes in humidity.

Two parallel wide flat struts 11 and 12 support the area of the soundboard adjacent sound port or aperture 15 have one side 11 longer and the other side 12 shorter and lie perpendicular to strut 14 and diagonal to strut 6. Struts 11 and 12 reinforce the aperture and isolate any sonic disturbance caused by air rushing in and out from the aperture for interacting with and distorting the sound. The majority of small plucked string instruments are wholly enclosed except for the port. The port allows for free air movement at the lower frequencies which produce the greatest air displacement. As will be explained in more detail below, a larger instrument such as a piano has a substantially larger soundboard surface can produce the lower frequencies more efficiently so that it does not need and does not employ a port.

Diagonal stop strut 6 is so disposed that its bass side 19 is located at or above the center of aperture 15 and the treble side is located at a much lower level and lies approximately midway from the active middle strut 3. Strut 3 is perpendicular to the bridge 9A, the middle of the bridge bisecting the middle of strut 3. Strut 6 and tremble strut 7 intersect at A and form an equilateral triangle ABC with strut 3, having equal sides AB, BC and CA.

Treble strut 7 is wider and shorter than the bass transverse strut 8 which is narrower and longer to make the tremble side even stiffer as compared to the bass side. Strut 8 intersects active bass struts 4 and 5, the active middle strut 3 and the treble strut 7.

Figure 2:
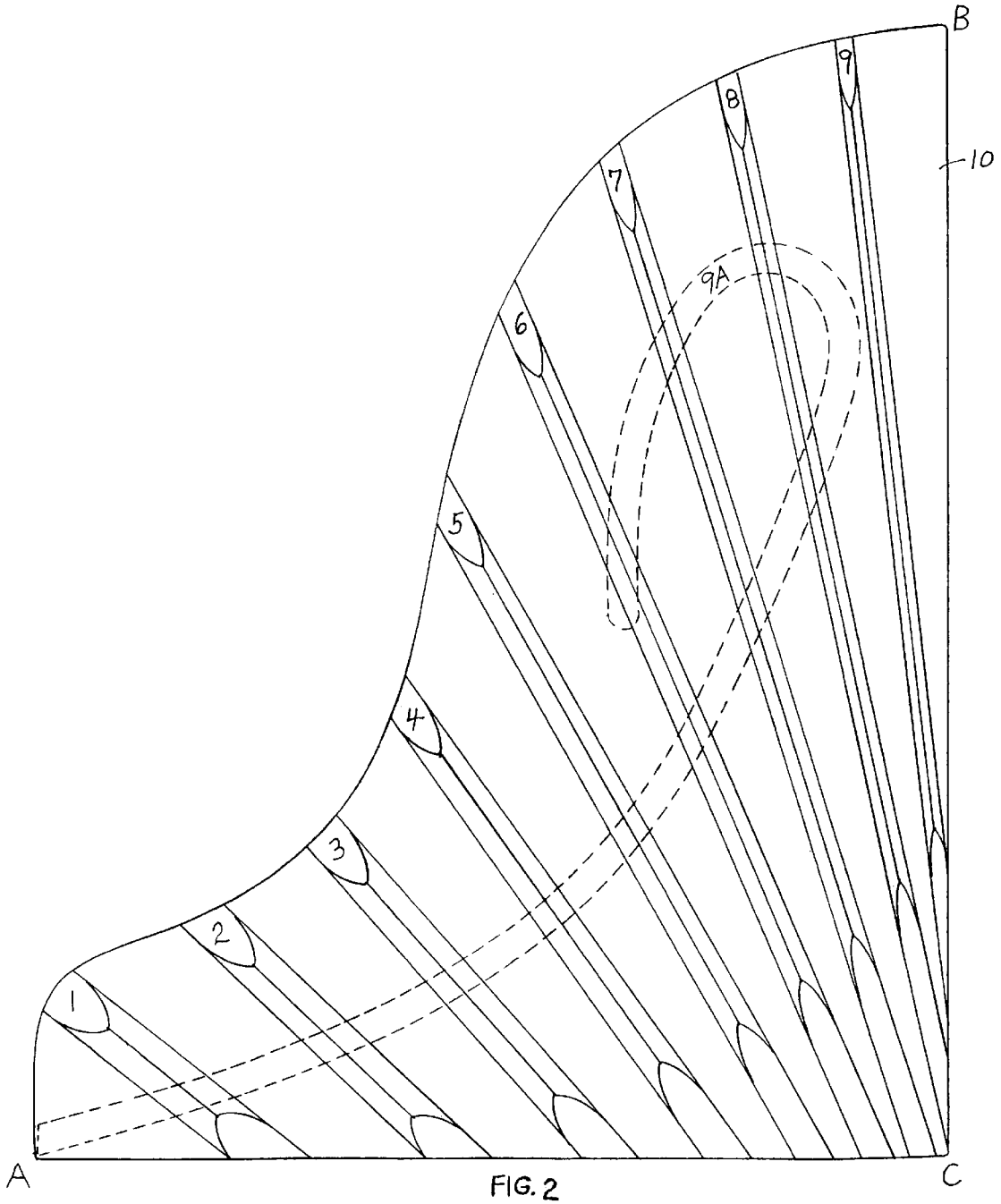
FIG. 2 is a schematic view of the underside of a soundboard system of a grand piano in accordance with the invention.

Five active struts 1, 2, 3, 4 and 5 define a fanned arrangement resembling the tail of a bird and define the area wherein all the frequencies from lowest to highest are replicated efficiently. In FIGS. 1 and 2, all active struts are at an angle except active middle strut runs parallel with flat wide struts 11 and 12 and is perpendicular to the bridge 9A.

In FIG. 1, the fanned struts are progressively graduated in width and in length from shorter and wider secured to the treble side to longer and narrower struts secured to the bass side, with the common middle strut 3 which divides the treble side from the bass side thus making the treble side stiffer and the bass side more compliant. The upper parts of the fan arrangement that come into contact with strut 6 occupy an area that closely coincides with struts 11 and 12 with the individual strut centers equally divided. The lower parts of the fan arrangement are substantially separated and arranged so that active treble struts 1 and 2 that come into contact with treble strut 7 are equally divided along its extent. The active middle strut 3 divides the symmetrical soundboard 10 in half while active bass struts 4 and 5 which engage bass strut 8 are equally divided from the middle of active strut 3 to its peripheral edge 21.

Turning now to FIG. 2, the same principal of fanning arrangement as employed in FIG. 1 is employed. However more active struts 1 through 9 are used. Moreover, the soundboard is much larger and bridge 9A consists of a single curved piece of wood which is positioned equidistantly from active struts 1–9. This is the most active vibrating portion of the soundboard which has a wing like asymmetrical shape.

In FIG. 2, the lowest parts of the fan struts 1 through 9 are much closer together at the extreme bass side C and rapidly separate in a non linear progression with the widest separation occurring at A, the extreme treble side. These struts are progressively inclined from a minimum angle at bass side BC for strut 9 to a maximum angle at treble side AC for strut 1. The active bass struts 7 through 9 have the smallest inclination for better low frequency response as compared to the active treble struts 1 through 3 having the largest inclination. The treble struts thus are stiffer for better high frequency response. The middle struts 4 through 6 have an intermediate inclination for improved middle frequency response.

All the struts are feathered or tapered downward at each end. This tapering permits easier and firmer gluing or otherwise securing the strut to the soundboard as well as enabling the thickness of the soundboard to be somewhat reduced.

While this invention has been described with particular reference to the drawings and detailed description, the protection solicited is to be limited only by the terms of the claims which follow.

What is claimed is:

1. A soundboard system for a stringed musical instrument comprising:

a soundboard having first and second opposite surfaces;

a bridge to which strings can be attached, said bridge being secured to said first surface;

a plurality of spaced apart elongated narrow struts secured to said second surface, said struts defining a strut array, said struts being progressively graduated in width and length, the shorter and wider struts being treble struts and being disposed along one side of the second surface, the longer and narrower struts being bass struts and disposed along the other side of the second surface, a middle strut in the array being disposed in a position dividing one side from the other.

2. In an acoustical musical stringed instrument having a flat soundboard with opposite top and bottom surfaces and wherein strings are secured by a bridge to said top surface, the strings when plucked cause the soundboard to vibrate to produce sound with a single resonance frequency, the strings that produce higher frequency sounds being disposed along a first side of the top surface, the strings which produce lower frequency sounds being disposed along a second side of the top surface of the board, the two sides oppositely disposed with respect to each other, the improvement comprising:

a plurality of elongated struts secured to the bottom surface of the soundboard in spaced apart positions, said struts causing the first side of the top surface of the soundboard to function as if it were stiffer and relatively short and wide and cause the second side of the top surface to function as if it were more compliant and relatively longer and narrower, said struts being progressively graduated in width and length from shorter and wider struts secured to the first side of the bottom surface to longer and narrower struts secured to the second side of the bottom surface whereby when the strings of the instrument are plucked to produce sound, the resonant frequency is enhanced by increasing the number of harmonics of higher frequency of the resonant frequency and the richness of sound is substantially enhanced.

3. The improvement of claim 2 wherein said struts have flat bottom surfaces secured to the bottom surface of the soundboard.

4. The improvement of claim 3 wherein the opposite ends of each strut is feathered.

5. The improvement of claim 3 wherein the soundboard is a piano soundboard.

6. The improvement of claim 3 wherein the soundboard is a guitar soundboard.

7. The improvement of claim 2 wherein the soundboard has an opening defining a sound port.

8. The improvement of claim 2 wherein the soundboard lacks a sound port.

* * * * *